United States Patent [19]

Haase

[11] Patent Number: 4,611,811

[45] Date of Patent: Sep. 16, 1986

[54] BINGO GAME WITH MEANS TO CHANGE PART OF THE BINGO PATTERN

[76] Inventor: Robert Haase, 1639 Mardell Street, London, Ontario, Canada, N5V 1X3

[21] Appl. No.: 594,882

[22] Filed: Mar. 22, 1984

[51] Int. Cl.[4] ..... A63F 3/06

[52] U.S. Cl. ..... 273/237; 273/281; 273/284; 273/DIG. 28; 273/269

[58] Field of Search ..... 273/85 E, 85 F, 237, 273/238, 268–274, 281–284, 280, 1 ES; 364/410–412

[56] References Cited

U.S. PATENT DOCUMENTS

| | | | |
|---|---|---|---|
| 3,386,739 | 6/1968 | Lino . | |
| 3,588,113 | 6/1971 | Nelson . | |
| 3,860,242 | 1/1975 | Martin | 273/284 |
| 3,909,001 | 9/1975 | Feldhausen . | |
| 3,984,107 | 10/1976 | Nelson . | |
| 3,995,862 | 12/1976 | Bertin . | |
| 4,341,386 | 7/1982 | Kleva | 273/284 |
| 4,348,027 | 9/1982 | Escamilla-Kelly | 273/284 |
| 4,453,718 | 6/1984 | Christoperson | 273/284 |
| 4,455,025 | 6/1984 | Itkis | 273/269 |
| 4,475,157 | 10/1984 | Bolan | 273/237 |

*Primary Examiner*—Richard C. Pinkham

*Assistant Examiner*—Mary Ann Stoll Lastova

*Attorney, Agent, or Firm*—Fleit, Jacobson, Cohn & Price

[57] ABSTRACT

An improved bingo display for use in manual or video electronic games. In the manual version, a bingo card contains permanently written numbers in the N-column and the third row. The remaining sixteen squares define four discrete groups of four squares each and there is a disk secured to and on top of each discrete group. The disks with unique symbols thereon can be rotated by a player so that the numbers or symbols thereon can be positioned in their traditional position or rotated during play so that the number or symbols on one square can be moved to another square and a bingo may be obtained. In the electronic embodiment, numbers in the N-column and third row through the free space are a first color at the start of the game. The remaining sixteen squares of groups of four are of a second color but are continuously changing color in a random pattern. After a predetermined period of time, certain of the sixteen squares take on the first color while others remain the same. At this point, the player is permitted to rotate the four squares within any one of the four corner groups to relocate the numbers and colors in those squares to new locations and increase the chances of scoring many bingos.

11 Claims, 10 Drawing Figures

FIG. 6

| 11 | | | | |
|---|---|---|---|---|
| B | I | N | G | O |
| 12 | 23 | 40 | 54 | 61 |
| 8 | 17 | 36 | 50 | 63 |
| 14 | 16 | X | 48 | 74 |
| 5 | 19 | 42 | 58 | 62 |
| 3 | 21 | 33 | 47 | 66 |

FIG. 8

| 11 | | | | |
|---|---|---|---|---|
| B | I | N | G | O |
| 8 | 12 | 40 | 50 | 54 |
| 17 | 23 | 36 | 63 | 61 |
| 14 | 16 | X | 48 | 74 |
| 3 | 5 | 42 | 58 | 62 |
| 21 | 19 | 33 | 47 | 66 |

141 142 143 144

FIG. 7

| 11 | | | | |
|---|---|---|---|---|
| B | I | N | G | O |
| 12 | 23 | 40 | 54 | 61 |
| 8 | 17 | 36 | 50 | 63 |
| 14 | 16 | X | 48 | 74 |
| 5 | 19 | 42 | 58 | 62 |
| 3 | 21 | 33 | 47 | 66 |

FIG. 9

| 11 | | | | |
|---|---|---|---|---|
| B | I | N | G | O |
| 8 | 12 | 40 | 50 | 54 |
| 17 | 23 | 36 | 63 | 61 |
| 14 | 16 | X | 48 | 74 |
| 3 | 5 | 42 | 58 | 62 |
| 21 | 19 | 33 | 47 | 66 |

BINGO GAME WITH MEANS TO CHANGE PART OF THE BINGO PATTERN

FIELD OF THE INVENTION

The present invention relates to improvements in gaming apparatus, in general, and to an improved game board and playing concept applied to bingo type games, in particular.

BACKGROUND OF THE INVENTION

Bingo is a traditional game of chance in which players play markers on a pattern of numbered squares, according to numbers drawn and announced by a caller. A standard bingo card is generally square shaped and is divided into twenty-five squares arranged in a regular array to form five columns and five rows. At the head of each column is one of the letters of the word bingo. Thus, above the first column is the letter B and each of the five squares in the B-column may contain one of the numbers between 1 and 15. The squares of the I-column may contain numbers 16 through 30. Under the N-column, all of the squares except the center square may contain numbers 31 through 45. Under the G-column, numbers 46 through 60 may appear in the squares, and, finally, under the O-column numbers 61 through 75 may be used. Traditionally, the center square or space is designated as a free space and may be marked by the player without any action by the caller.

In a traditional game of bingo, the caller selects a number by removing a marked ball from a container. Each ball is marked with a number between 1 and 75. If a player's bingo card contains the number that is called, the player covers that number with a marker, such as a transparent colored disk. The caller continues to draw balls and call numbers until one of the players has obtained a bingo. Typically, a bingo consists of having all five of the numbers in any of the rows, columns or diagonals of the bingo card.

Over the years, there have been few if any changes to the game of bingo. Because it is played essentially as a game of chance, a certain amount of luck is necessary to select a particular bingo card in the hopes of being the first to obtain a bingo in a given game. In addition, bingo is often used as a means of raising money for charitable organizations and it would be unprofitable for those organizations, if during the course of a bingo game, a large number of players obtained bingo at the same time. For these reasons, certain standards have developed with regard to the placement of numbers within the given squares of a bingo card. At the present time, there are thousands of different standard bingo cards. Each of the standard cards bears a unique numerical arrangement and a card bearing a particular designation number will have the same numerical arrangement no matter what part of the country the game of bingo is being played.

In an average bingo session, in addition to using standard cards and playing for the standard bingo, certain variations, or special games, are played. For example, one special game might consist of obtaining all of the numbers on a given card. Also one might try to obtain the four corners or different letters of the alphabet.

Over the years, there has been very little in the way of improving or altering the traditional game of bingo. Most improvements have been directed toward finding better ways to cover numbers during the course of a game. Other improvements relate to altering some of the number arrays within the individual card. For example, see U.S. Pat. Nos. 3,909,001 (Feldhausen) and 3,386,739 (Lino).

However, none of the traditional aspects of bingo nor the improvements made in the prior art address the issue of providing an intellectual challenge to the player and creating greater elements of skill within the traditional setting of the game of bingo. The present invention is directed toward filling those needs.

SUMMARY OF THE INVENTION

The present invention relates to improvements in both the playing concept and apparatus associated with the game of bingo. Improvements are directed toward providing a manual embodiment using an improved bingo card as well as an electronic embodiment incorporated into an electronic video game derived from the teachings of the invention.

In the manual implementation of the teachings of the subject invention, a traditional bingo card contains permanently written numbers in the N-column and in the third row through the free space square. The remaining sixteen squares are blank. These sixteen squares comprise the four corners of the bingo card. Placed over the group of four squares located in each corner of the bingo card is a slightly smaller square disk divided into four squares, with each square bearing a unique numerical designation or indicia. These indicia bearing disks are secured to each corner area of the bingo card by eyelets or the like so that the player may rotate the small disks about the eyelets. In this way, the numbers in each corner of each disk may be positioned wtihin one of the squares of the bingo card. At the beginning of a bingo game, the four smaller square disks are oriented so that the numbers which appear on them are positioned in their traditional position according to one of the known standard bingo cards. During the course of play, the caller calls out the numbers in the customary manner and the player covers the called numbers with a bingo marker. If during the course of the game, a player discovers that by rotating one of the square disks and moving the numbers from one square to another, a bingo may be obtained, the player may rotate one or more of the smaller square disks and win the game. It is contemplated that the player is permitted to rotate one or more of the smaller square disks when the rotation will yield a bingo or is likely to yield a bingo, for example, when the player is one number away from a bingo.

The electronic embodiment of the subject invention is in the form of an electronic video game in which the video or CRT display shows a bingo card. When a player inserts a coin or token into the machine, the video display asks the player to select a card. He does so through a control panel and may select any one of a variety of preprogrammed standard cards. When the player has found a card that he wishes to retain, he then presses a control button on the console of the video game and the game begins. At first, the squares in the N-column and third row through the free space light up or change color so that they contrast or stand out from the remaining squares. This is to indicate to the player that the numbers within those squares have been awarded to him in the form of two bingos. The remaining sixteen squares, which are arranged in groups of four in each corner of the card, are continuously flashing on and off in a random pattern. After a predetermined period of time, certain of the sixteen squares show lights and a change in color while others remain unlit with no change in color. At this point, the player is permitted to, in effect, rotate the four squares within any one of the four corner groups to relocate the numbers in those squares and their background color to new locations. This is where the element of skill enters the game. The person rotates one or more of the groups reorienting the squares and their numbers in any way he wishes to provide his best chances to score as many bingos as possible and thus obtain more points. After making his final selection, he then presses another button and the final round of lights flashing and color changes takes place.

All of the numbers which were lit at the time that the player made his final selection remain lit and the possibility exists that new squares will light and change color to provide further bingos at the end of the game. Depending on the outcome of the final light flashing sequence, the player will either score more points and receive a pay off or end the game with no recovery.

It is thus an object of the present invention to improve the game of bingo by adding elements of skill to the traditional game of chance.

It is another object of the present invention to provide an improved apparatus for playing the game of bingo.

It is still an object of the present invention to provide a video implementation of an improved game of bingo having elements of skill.

These and other objects will become apparent in the figures and detailed description which follow.

BRIEF DESCRIPTION OF THE DRAWINGS

FIGS. 6 through 9 are diagrams of what appears on the video screen of the embodiment of FIG. 5 and are used to explain the subject invention.

DETAILED DESCRIPTION OF THE PREFERRED EMBODIMENTS

The present invention relates to an improvement in both the game apparatus and the method of playing the traditional game of bingo. Both mechanical and electrical forms of the invention are contemplated.

Figure 1:
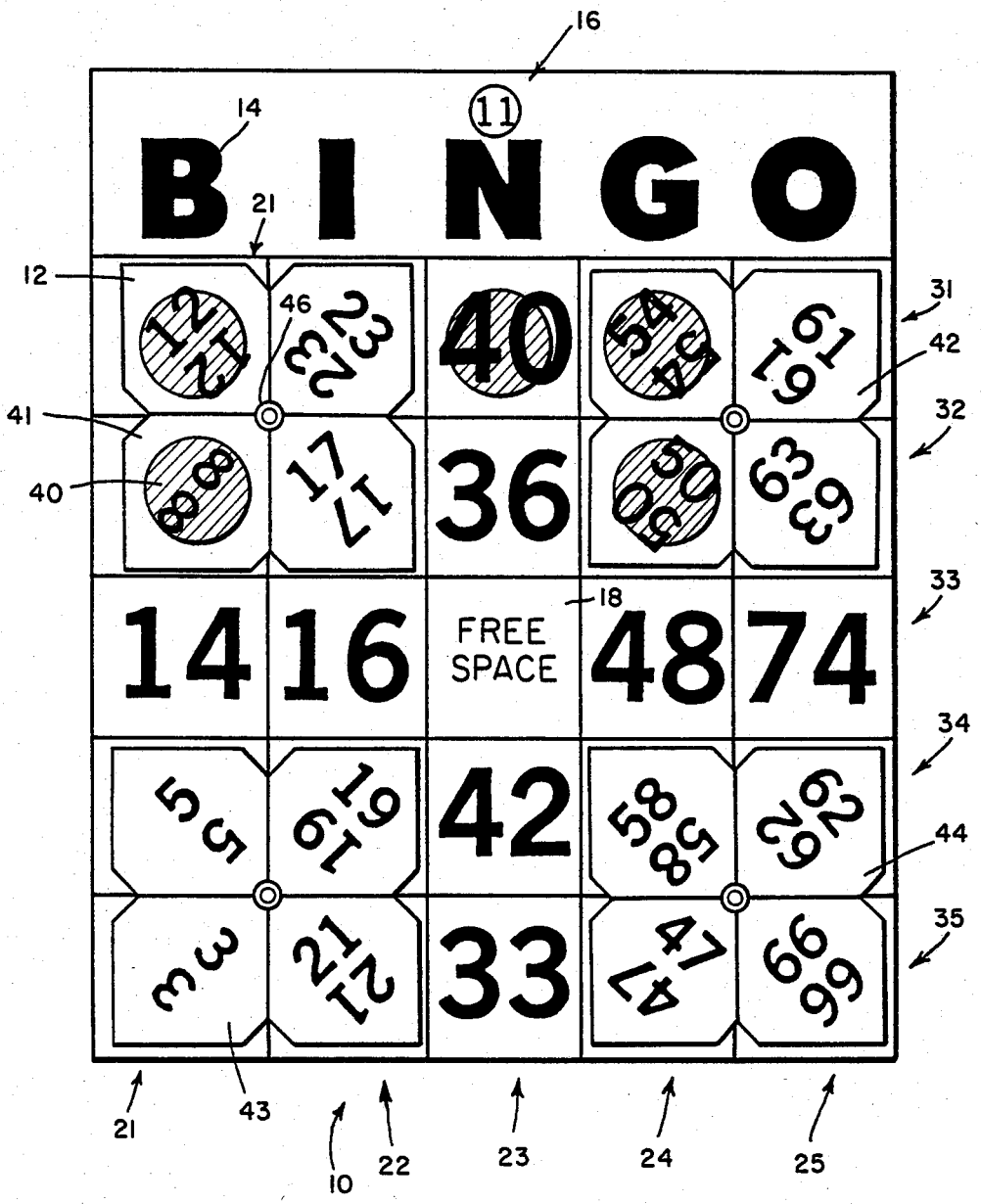
FIG. 1 is a planar view of a bingo card incorporating the teachings of the subject invention.
Figure 2:
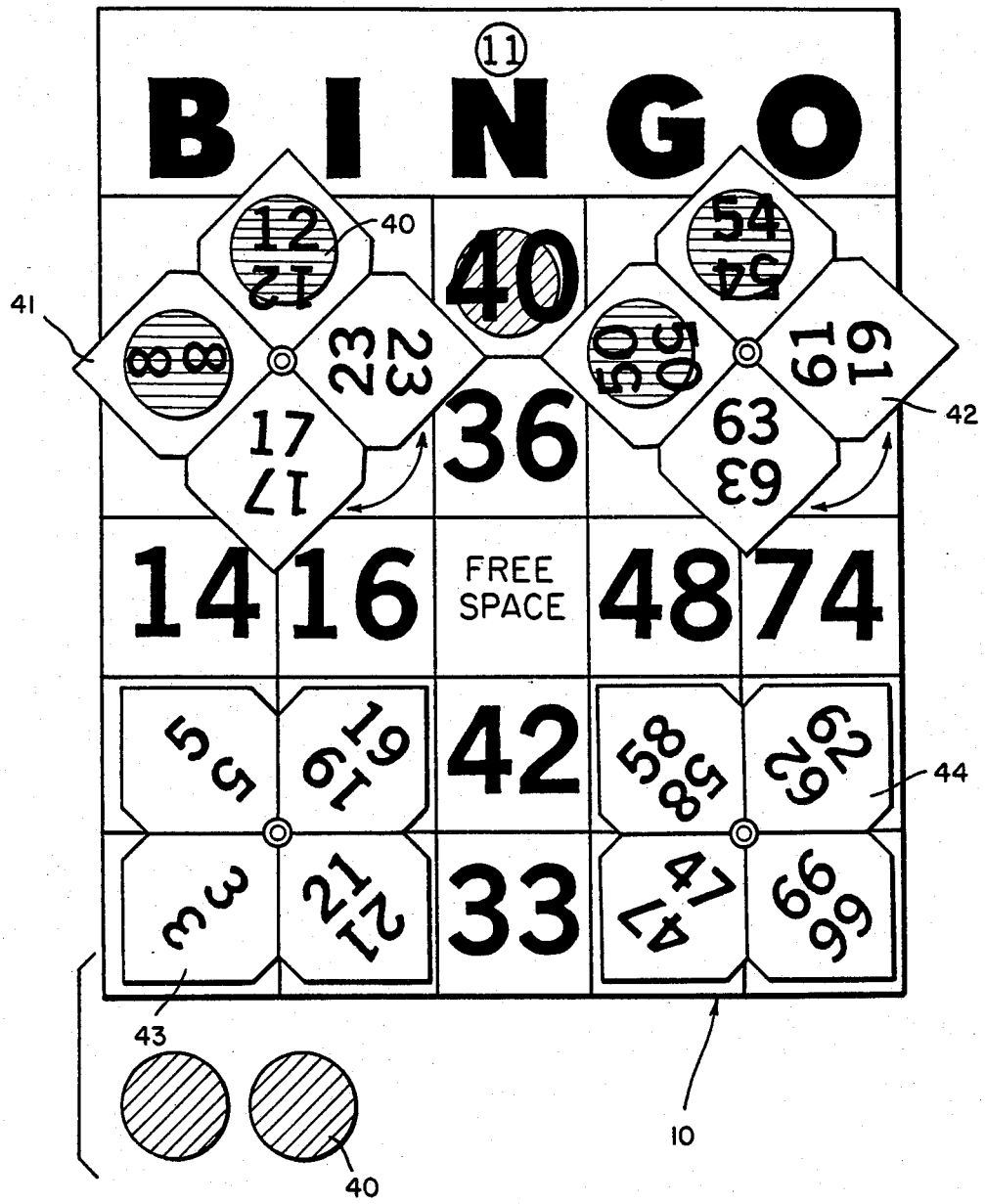
FIG. 2 is a planar view of the bingo card of FIG. 1 showing the rotating disks being oriented in accordance with the teachings of the subject invention.
Figure 3:
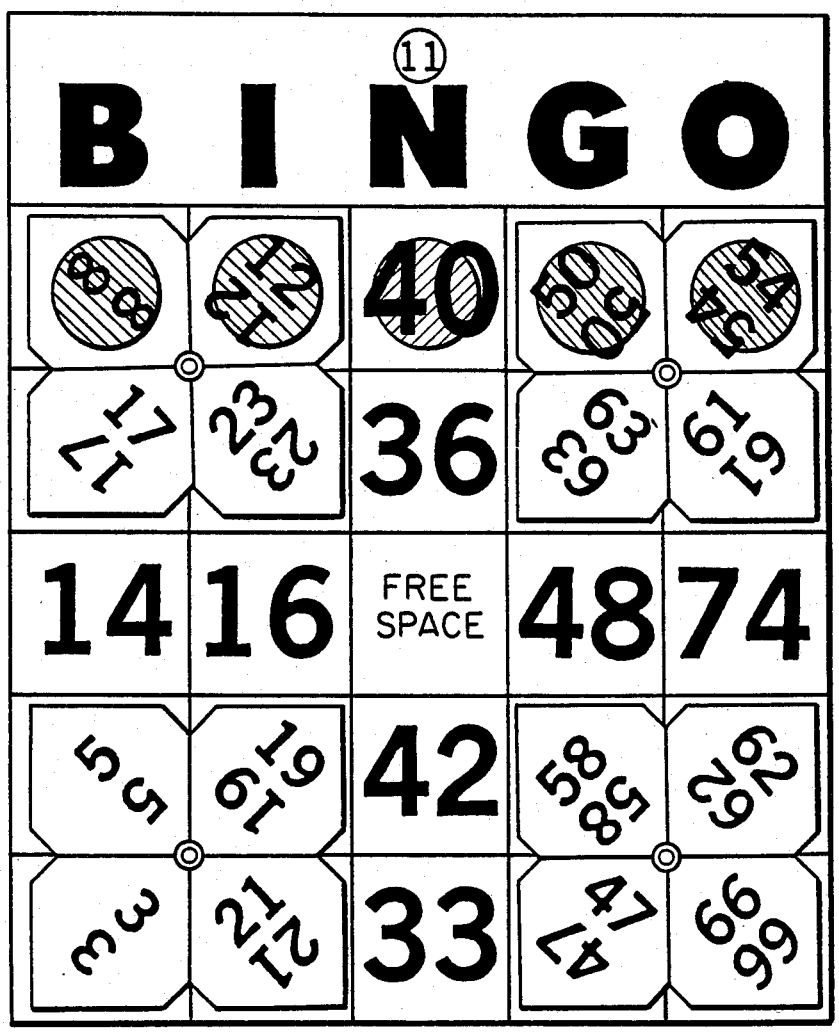
FIG. 3 is a planar view of the bingo card of FIG. 1 with the disks being fully reoriented to reveal a bingo.

In the mechanical embodiment of the subject invention, the improvement over the traditional game of bingo is found in the bingo card itself. With reference to FIGS. 1 through 3, a bingo card is shown generally designated as 10. The card, which may be made of paper, cardboard, or in a preferred embodiment, out of plastic, is generally square shaped and is divided into 25 squares of equal size. The squares are arranged in five columns 21 through 25 and five rows 31 through 35. At the head of each column is the letter of the alphabet 14 to spell out the word bingo with one letter being associated with each column. Above the letter N is a number 16 which is the unique designation for the card.

For sometime, there has existed within organized bingo a standard set of bingo cards. Currently, there are recognized literally thousands of unique cards, each having a different numerical arrangement. With regard to FIG. 1, the card shown in that figure is card number 11 and the arrangement of the numbers within the various squares of the card is standard for all cards which bear the designation 11. At the center of the card is a free space 18 which contains no number. This space is awarded to the player before any numbers are called by the caller. As numbers are called by the caller, the player examines his card to see if he has the designated number. If he does, he then places a marker 40 over the number which has been called. As shown in FIG. 1, markers have been placed over the squares bearing the numbers 8, 12, 40, 50 and 54. The markers are typically transparent plastic disks so that the user may see the underlining number at all times.

In a traditional bingo card, all of the numbers are permanently fixed in the squares and all of the numbers are of the same size. An example of this is seen in the N-column or the third row of the card in FIG. 1. The present invention departs from the traditional card through the inclusion of the four generally square disks 41 through 44.

Disk 41 is positioned to occupy the four squares or section in the upper left-hand corner of the card. As can be seen, disk 41 contains four squares arranged in a $2\times2$ array. In like manner disk 42 is placed in a superposed relationship to cover the four squares in the upper right-hand corner. Disk 43 is placed in the lower left-hand corner and disk 44 is placed in the lower right-hand corner. Each of the disks are secured to the underlying card for rotation about their diagonal intersection through a suitable fastening means such as an eyelet 46.

Figure 4:
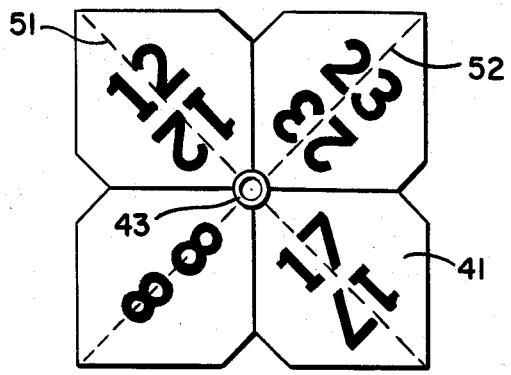
FIG. 4 is a planar view of a disk used in conjunction with the card of FIG. 1.

With reference to FIG. 4, along the two diagonals 51 and 52 of disk 41 there are positioned four pairs of numbers, one pair at each corner of the disk. For example, along diagonal 51 starting at the upper left-hand corner of the disk is a 12 then an inverse 12 followed by a 17 and an inverse 17. Returning now to FIG. 1, it can be seen that by arranging the numbers in this way on the disk, the numbers are still legible no matter what orientation the disk is placed in. An axis of rotation which is generally perpendicular to the surface of the disk is defined at the intersection 43 of the diagonals at the center of the disk.

At the beginning of a game of bingo, the four disks are oriented as shown in FIG. 1 in order to duplicate the numeric placement for a number 11 card. A player leaves the card with the four square disks in this orientation as the game begins.

The caller initiates the game by drawing numbers in a traditional manner such as the use of numbered balls in a cage. As a player's number is called, the player covers that number with a marker 40 such as is illustrated in FIG. 1. If during the course of the game, the player discovers that by reorienting the numbers in the squares, he can obtain a bingo, then he is permitted to do so. As shown in FIG. 1, rotation of squares 41 and 42 by 90° in a clockwise direction about axis 43 will yield a bingo as shown in FIG. 3. FIG. 2 shows the two squares 41 and 42 at the mid point during the rotation into their position as shown in FIG. 3. According to a preferred way of playing the game, the player is permitted to rotate one or more of the squares any amount and only when the rotation will yield a bingo.

Figure 5:
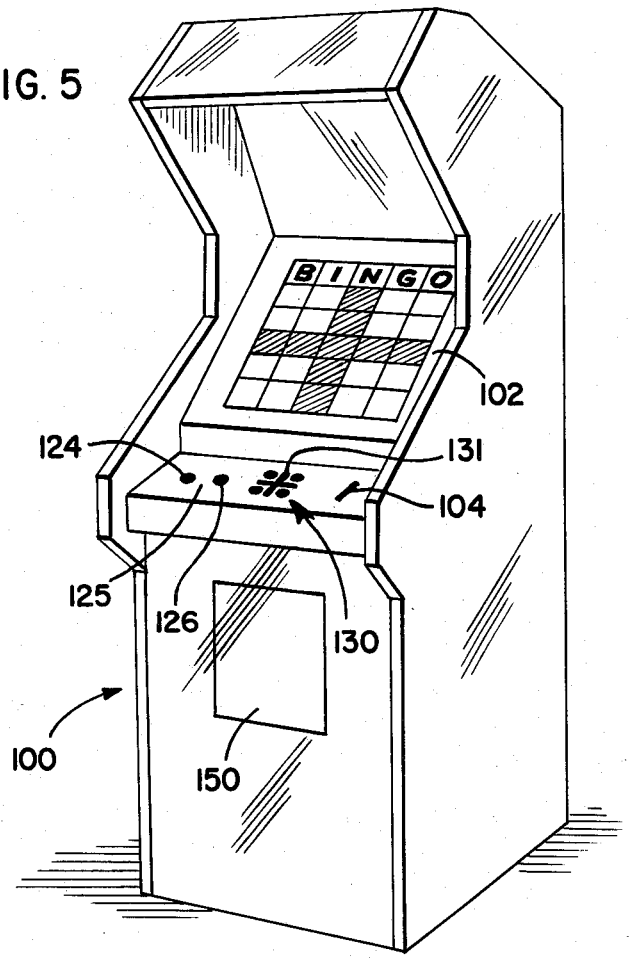
FIG. 5 is a diagram of a video game console incorporating the teachings of the subject invention.
Figure 10:
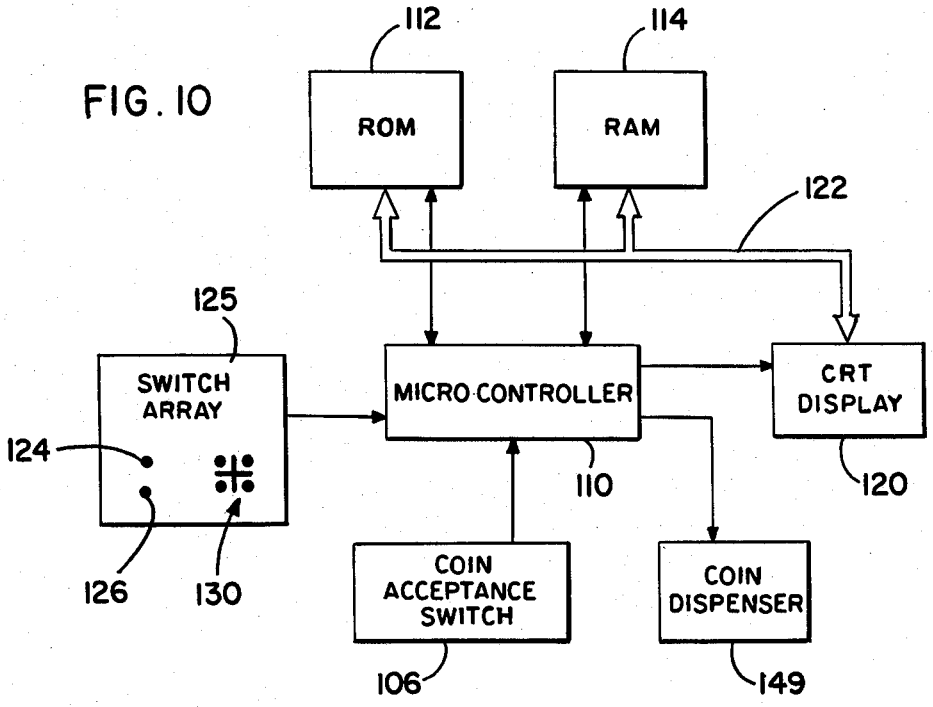
FIG. 10 is a schematic diagram showing the basic operative circuitry found in the embodiment of FIG. 5.

With reference to FIGS. 5 through 10, an electronic embodiment of the subject invention will now be described. FIG. 5 schematically illustrates a standup video console generally designated as 100. To use such a console, a player would stand in front of it and observe the video display 102 during the play of the game. A coin slot 104 is provided to receive the player's coin or tokens to initiate the game. FIGS. 6 through 9 illustrate various screens displayed during the course of the game and are used to explain how the game is played.

When a player puts a coin into the slot 104, the coin activates a coin acceptance switch 106 which sends an acceptance signal to a microprocessor or microcontroller 110. The microprocessor reacts by initiating a gaming cycle. Cooperating with the microprocessor is a read only memory (ROM) 112 which contains the operating sequence for the video game. In particular, a selected portion of the ROM contains in a look-up table the data necessary to generate any one of the standard bingo cards. It is contemplated that the ROM will be of sufficient size to store several thousand differnet cards. Another portion of the ROM is dedicated to the operating system to carry out the various functions of the game. A random access memory (RAM) 114 is used to temporarily store data during the course of the game. Data is transferred from the ROM 112 or the RAM 114 to a video or CRT display 120 along the data bus 122.

As stated before, the operation cycle of the video game is initiated through the reception of a coin acceptance signal by the microcontroller 110. At this point, a question appears on the video screen 102 asking the player which bingo card he wishes to use. Through a conventional pressure sensitive switch or joy stick arrangement 124, the player may select any one of the standard cards. When a desired card is displayed on the video screen 102, the player then presses another contact switch 126 in order to freeze that card into position on the screen. Once this has been done, the microcontroller is notified that the player has selected a particular card and the next phase of the game begins under the control of the microcontroller.

As shown in FIG. 6, the player has selected card 11 with the number placement as shown. Upon selection of the card, the microcontroller causes the CRT to display all of the squares in the N-column and third row as the same color light intensity. The remaining 16 squares are of a different color from the color associated with the squares of the N-column or third row. After this has taken place, the microcontroller 110 interrogates the ROM 112 and through a random number generator, causes certain of the corner squares to take on the color associated with the N-column or third row. All of the corner squares will alternate in a random pattern between their original color and the altered color. Eventually, certain of the squares will take on the altered color as shown in FIG. 7 by the hatch lines. The player is then prompted to determine which, if any, of the four groups of squares he wishes to relocate in order to either obtain a bingo or to improve his chances of obtaining further bingos upon continuation of play. The rotation is accomplished by pressing one of four contact switches 130 located on the panel or console 125. Each of the switches is located with one of the corner groups as shown on a template 131 contained on the console 125. By pressing one of the buttons, the player is able to, in effect, rotate the numbers from square to square in a clockwise direction. With reference to FIG. 8, the player has elected to rotate the four squares contained in group 141, the squares in group 142, and the squares in the group 143, while leaving the squares in group 144 unchanged.

With continued reference to FIG. 8, the rotation of groups 141 and 142 have yielded a bingo in the first row. In addition, the player has elected to rotate group 143 in order to reposition the covered number 3 from its original position and to reorient the numbers in the remaining squares. When the player is satisfied with the way the numbers have been relocated he then presses switch 126 which sends a signal to the microcontroller 110 to continue the gaming cycle. At this point, the microcontroller again causes the video display to randomly alter the color the remaining squares or blocks which contain the original color. At the completion of this random cycle, certain of the blocks of the original color will now take to the altered color as shown by the hatch lines in FIG. 9. As can be seen in FIG. 9, the rotation of the block of four squares 143 has allowed the player to obtain a further bingo in the B-column. Had he not rotated the block of squares 143, he would not have obtained that bingo at the conclusion of the game.

At the end of the game, the microprocessor evaluates how many bingos the player has obtained and, through a look-up table in the ROM 112, determines the reward to be made to the player based on the original amount of money inserted by the player. In some situations, the microprocessor then develops a coin discharge signal and activates a coin dispenser 149 to dispense the appropriate number of coins in a coin tray 150 located on the machine. In other situations, the coin dispenser is replaced by a ticket dispenser or the video display exhibits a free game credit.

Obviously, many modifications and variations of the present invention are possible in light of the above teachings, and it is contemplated the subject invention may be implemented through the use discrete components or integrated circuit chips. Therefore, it is to be understood that within the scope of the appended claims, the invention may be practiced otherwise than as specifically described.

What is claimed is:

1. An electronic game apparatus for use by a player, said apparatus comprising:

electronic means for permanently storing a plurality of different playing patterns with each pattern comprising a plurality of sections arranged in an array;

means for electronically selecting a particular pattern by player command;

alterable electronic means for displaying a planar playing surface comprising said selected pattern;

means for creating a unique symbol for the life of a game in a predetermined number of sections of said electronically displayed array, said predetermined number of unique symbols filling only a portion of said electronically displayed sections and thereby defining a plurality of remaining sections;

means for displaying a first color in each of said predetermined sections;

said remaining sections of said electronically displayed array comprising discrete groups of adjacent sections which temporarily display for a time less than the life of the game a second color different than said first color with each discrete group of adjacent sections defining a playing area of lesser dimension than said electronically displayed selected pattern;

additional means for displaying said first color in selected ones of said remaining sections in each of said discrete groups, said additional means having means to relocate said first color in selected ones of said remaining sections to different sections within the same discrete group in response to player commands; and means for alterably displaying and relocating a further unique symbol in each of said remaining sections of a discrete group, said means for alterably displaying comprising means for relocating said further unique symbols from their original location in a respective section of one of said discrete groups to any other section of said same discrete group in response to additional player commands, and relocating said further unique symbols of one discrete group relative to said unique symbols and relative to said further unique symbols of said other discrete groups.

2. The electronic game apparatus of claim 1, wherein said alterable electronic display includes a cathode ray tube.

3. The electronic game apparatus of claim 1, wherein each of said sections is a square and the dimensions of said array is 5 squares by 5 squares.

4. The electronic game apparatus of claim 3, wherein said array has 5 rows and 5 columns with the squares of a third row and a third column constituting said predetermined number of said sections.

5. The electronic game apparatus of claim 4, wherein said remaining squares are divided into four discrete groups, each group consisting of four squares, and each discrete group occupying one of the four corners of the array of said playing surface.

6. An electronic game apparatus for use by a player, said apparatus comprising:

electronic means for permanently storing a plurality of different playing patterns with each pattern comprising a plurality of sections arranged in an array;

means for electronically selecting a particular pattern by player command;

alterable electronic means for displaying a planar playing surface comprising said selected pattern;

means for creating a unique symbol for the life of a game in a predetermined number of sections of said electronically displayed array, said predetermined number of permanently created symbols filling only a portion of said electronically displayed sections and thereby defining a plurality of remaining sections;

means for displaying a first color in each of said predetermined number of sections;

said remaining sections of said electronically displayed array comprising discrete groups of adjacent sections which temporarily display for a time less than the life of the game a second color different than said first color with each discrete group of adjacent sections defining a playing area of lesser dimension than said electronically displayed selected pattern; and additional means for displaying said first color in selected ones of said remaining sections in each of said discrete groups, said additional means having means to relocate said first color in selected ones of said remaining sections to different sections within the same discrete group in response to player commands.

7. The electronic game apparatus of claim 6, wherein said relocating means include means for randomly changing the second color of one or more of said remaining sections to said first color.

8. The electronic game apparatus of claim 6, wherein said alterable electronic display includes a cathode ray tube.

9. The electronic game apparatus of claim 6, wherein each of said sections is a square and the dimensions of said array are 5 squares by 5 squares.

10. The electronic game apparatus of claim 9, wherein said array has 5 rows and 5 columns with the squares of a third row and a third column constituting said predetermined number of said sections.

11. The electronic game apparatus of claim 10, wherein there are four discrete groups with each having four squares each and occupying the four corners of said playing surface.

* * * * *